US006994144B2

(12) United States Patent
Fletcher

(10) Patent No.: US 6,994,144 B2
(45) Date of Patent: Feb. 7, 2006

(54) GARAGE DOOR REINFORCEMENT DEVICE

(76) Inventor: Kenneth W. Fletcher, 48 Albion Street, Kitchner, Ontari (CA) N2E 2N4

( * ) Notice: Subject to any disclaimer, the term of this patent is extended or adjusted under 35 U.S.C. 154(b) by 0 days.

(21) Appl. No.: 10/666,623

(22) Filed: Sep. 17, 2003

(65) Prior Publication Data

US 2005/0056387 A1 Mar. 17, 2005

(51) Int. Cl.
*E05D 15/26* (2006.01)

(52) U.S. Cl. ..... 160/209

(58) Field of Classification Search ..... 160/209, 160/201, 202, 222, 234, 199; 52/127.2, 167.3, 52/720.3

See application file for complete search history.

(56) References Cited

U.S. PATENT DOCUMENTS

| | | | | |
|---|---|---|---|---|
| 3,708,917 A | | 1/1973 | Streeter | |
| 3,815,943 A | | 6/1974 | Hass | |
| 3,891,021 A | | 6/1975 | Geoffrey | |
| 4,996,795 A | | 3/1991 | Niswonger | |
| 5,205,096 A | | 4/1993 | Pace | |
| 5,331,786 A | | 7/1994 | Lippert | |
| 5,337,520 A | | 8/1994 | Uribe | |
| 5,371,970 A | | 12/1994 | Ganikon | |
| 5,706,877 A | | 1/1998 | Grisham et al. | |
| 5,732,758 A | | 3/1998 | Marko | |
| 5,819,834 A | * | 10/1998 | Wedekind | 160/209 |
| 5,967,216 A | * | 10/1999 | Mancini | 160/209 |
| 6,082,431 A | * | 7/2000 | Decola | 160/209 |
| 6,295,763 B1 | * | 10/2001 | Serba | 49/468 |
| 6,385,916 B1 | | 5/2002 | Marko | |
| 6,745,814 B2 | * | 6/2004 | Hoofard et al. | 160/201 |
| 6,776,210 B2 | * | 8/2004 | Wells | 160/209 |
| 6,796,361 B1 | * | 9/2004 | Campbell et al. | 160/209 |

* cited by examiner

*Primary Examiner*—David Purol
(74) *Attorney, Agent, or Firm*—McHale & Slavin P.A.

(57) ABSTRACT

The reinforcement device for bracing a building aperture cover, such as a garage door; automatically engages when the aperture cover is lowered and disengages when the door is raised. The device employs at least one upper anchoring element, cooperating with the door header, and one lower anchoring element, cooperating with the floor structure. Both the upper and lower elements are securely attached to aperture cover so that they effectively divide and support the span of the aperture cover against positive and negative wind loads.

4 Claims, 8 Drawing Sheets

GARAGE DOOR REINFORCEMENT DEVICE

FIELD OF THE INVENTION

This invention is directed to garage door reinforcement and, in particular, to a securement device especially suited for providing auto-engaging reinforcement to a garage door.

BACKGROUND OF THE INVENTION

Windstorms, such as tropical storms, tornados, storm bursts and hurricanes may place severe stress on buildings which, if left unchecked, can lead to property damage and loss of life. These storms may be slow moving providing time to prepare, or fast moving leaving very little time to prepare. In either case, high-velocity winds are often strong enough to remove roofs from buildings by breaching the building structure. Even if the roof and walls of a building are sufficiently strong to resist the winds produced by a storm, the building aperture covers, such as garage doors, often fail. Many devices have been developed to protect building aperture covers against damage from windstorms. Some of these devices are easier to install or operate than others, but all devices known require some type of manual action in order to provide reinforcement to the aperture cover. Therefore, if the homeowner is away or is not able to install the protective device due to a time constraint, the structure will not be properly protected from a storm.

The largest aperture cover in the typical home is the garage door, some having a horizontal span exceeding 16 feet. High wind loads cause these large aperture covers to deflect across their unsupported spans. Once the aperture cover exceeds a given amount of deflection the cover will buckle or break. When a covering such as the garage door buckles under high wind loads, the garage is instantly pressurized. This often leads to a "domino" failure of the entire building structure. The instant pressurization of the garage causes the garage roof to be blown off the house. Once the garage roof blows off, the remaining roof blows off the house and the walls cave inward.

The proper use of reinforcement during high wind loads can effectively prevent the failure of a wide span garage door. Smaller building aperture covers may be sufficiently reinforced against buckling by installing a secondary fixed-panel over the aperture, for example, sheets of plywood anchored against the aperture periphery. Corrugated panels of aluminum or other rigid materials, removably mounted on permanent tracks, are used in other situations. These reinforcement methods are suitable for relatively small apertures. However, since these types of reinforcement panels do not collapse, they must be removed and stored when not in use. Weight and space requirements quickly become prohibitive factors as the size of the aperture to be covered increases. Panels sized to cover large windows or garage doors may be too heavy and cumbersome to move by a single person. The need for two-person installation severely limits the usefulness of this reinforcement method; a second person may not be available when a storm approaches, possibly preventing proper installation.

Folding, accordion-style panels are used as a way to address some of the shortcomings found in fixed-panel reinforcement methods. Folding panels typically require installation of one or more permanent guide tracks and are not suitable in all instances. For example, since accordion-style reinforcement devices are folded, not removed, during storage, sufficient space is required on either side of the aperture to accommodate the folded panels. Additionally, these types of reinforcing devices are often exposed to weather and require preventive maintenance to ensure that the stored panels will unfold easily and travel along the guide tracks when needed. Furthermore, folding-panel reinforcement devices are typically custom made, requiring specialized equipment and many hours of labor for production and installation. This tends to make folding panel reinforcements expensive.

Other known storm protection devices, permanently attach to the inside of garage doors, or are braces installed before a storm. These devices require manual engagement or installation. Manual engagement or installation is not always possible. Homeowners are often not capable of moving or installing these devices and there is likely to be a shortage of contractors available before a major storm capable of completing the installation. The limited amount of time available before a storm may leave some of the people who own this type of protective device without protection.

DESCRIPTION OF THE PRIOR ART

Devices that have been developed specifically to support garage doors include U.S. Pat. Nos. 3,708,917; 3,815,943; 3,891,021; 4,996,795; 5,205,096; 5,331,786; 5,337,520; and 5,371,970. Each discloses garage door supporting devices. However, these devices do not lower the stresses placed on the door mounting hardware and do not protect the reinforced door against damage from sustained wind loads. Additionally, these devices each require skill during installation.

U.S. Pat. No. 5,706,877 discloses a locking and reinforcing mechanism for a garage door wherein each door panel includes a set of telescoping tubes. To engage the protective device the operator must remove pins and manually slide the inner tube from one panel across to the next panel and replace the pin. After the device in engaged the door cannot be opened until the device is disengaged. To disengage the device the pin must again be removed, the inner tube returned to its original position, and the pin replaced to retain the tube.

U.S. Pat. No. 5,732,758 requires hand engagement and disengagement, and remains secured to a door even when not used. Although this arrangement is suitable for many settings, permanently attached reinforcement members add extra weight that may be undesirable in some cases.

The assignee recognized the shortcomings and developed a garage door reinforcement device for hurricanes. U.S. Pat. No. 6,385,916 reduces undesirable weight permanently attached to a garage door. This device provides proven protection against high wind loads, passing Miami Dade hurricane tests. Further, this device provides excellent support for older unreinforced doors. However, the device must be installed and removed by hand. Current construction regulations require the installation of stronger garage doors, thus, the overall support provided by the '916 patent can be reduced without reducing effectiveness.

None of the above noted devices is capable of providing protection to an aperture opening without some type of hand installation or engagement to utilize the device.

Thus, what is needed is an aperture cover reinforcement device that includes advantages of the known devices, while addressing the shortcomings they exhibit. The reinforcement device should passively operate, being automatically engaged and disengaged. The reinforcement device should also provide support against damage from both positive and negative wind loads. The reinforcement device should also allow unhindered operation of the garage door and not hinder ingress or egress of the aperture opening.

SUMMARY OF THE INVENTION

The present invention a reinforcement device suited for bracing a building aperture cover, such as a garage door; the device automatically engages when the aperture cover is lowered and disengages when the door is raised. The device employs at least one upper anchoring element, cooperating with the door header, and one lower anchoring element, cooperating with the floor structure. Both the upper and lower elements are securely attached to aperture cover so that they effectively divide and support the span of the aperture. A metal hook and wire rope loop arrangement is utilized in the upper elements while an engagement pin employing a tongue and groove arrangement is utilized in the lower element. The device is capable of providing protection against both positive and negative pressure wind-loads.

More particularly, the upper element includes an adjustable bracket assembly, a flexible wire rope loop, and a hook member. The bracket assembly includes two L-shaped elements having one leg adjustably attached to each other via bolts, screws, or a similar fastener to allow vertical adjustment of the bracket assembly with respect to the substantially parallel first and second ends. The first end of the bracket assembly is suitably attached to the top strut of the garage door via bolts, screws, or a similar fastener. The metal cable loop is constructed from a length of flexible wire rope, having each end attached to the second end of the bracket assembly to form a loop configuration defining an aperture. The metal hook member is attached to the aperture header so that it substantially aligns and cooperates with the wire rope loop.

The lower anchoring element includes an engagement pin and an anchor plate. The engagement pin is suitably attached to a mounting plate, such as by weldment, and attached to a vertical intermediate stile of the aperture cover via bolts, screws, or a similar fastener. The floor-mounted anchor plate includes a pin insertion aperture that accommodates the engagement pin. Below the insertion aperture is a suitable relief pocket in the floor for pin insertion. Bracing grooves disposed around the circumference of the first end of the engagement pin, engage corresponding pin passthrough aperture edges, as a tongue and groove arrangement, when the pin shifts laterally, as when a door reinforced by the present invention is subjected to wind loads. In this manner, the bracing notches prevent vertical motion of the support post during use.

Because the device is automatically engaged, the operator merely needs to lower the garage door to provide reinforcement. As the garage door is lowered the wire rope loop travels downward with respect to the metal hook member and the metal hook engages the wire rope loop aperture while the lower element engagement pin travels downward and is directed into the pin insertion aperture disposed in the lower anchor plate. As the garage door comes to rest on the garage floor surface, the device assumes a securing orientation that prevents unwanted movement of the aperture cover.

Thus, it is an objective of the instant invention to provide a reinforcement device for an upward opening aperture covering that is automatically engaged.

Another objective of the instant invention is to provide a reinforcement device for an upward opening aperture covering that provides support against damage from both positive and negative wind loads.

A further objective of the instant invention is to provide a auto-engaging reinforcement device for an upward opening aperture cover that minimizes the deflection of an aperture covering during high wind-loads.

An additional objective of the instant invention is to provide a auto-engaging reinforcement device that allows unhindered operation of the secured aperture cover.

Yet another objective of the instant invention is to provide a auto-engaging reinforcement device that does not require removal or storage between uses.

Still another objective of the instant invention is to provide an auto-engaging reinforcement kit which is suitable for installation on new as well as existing upward opening aperture covers.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
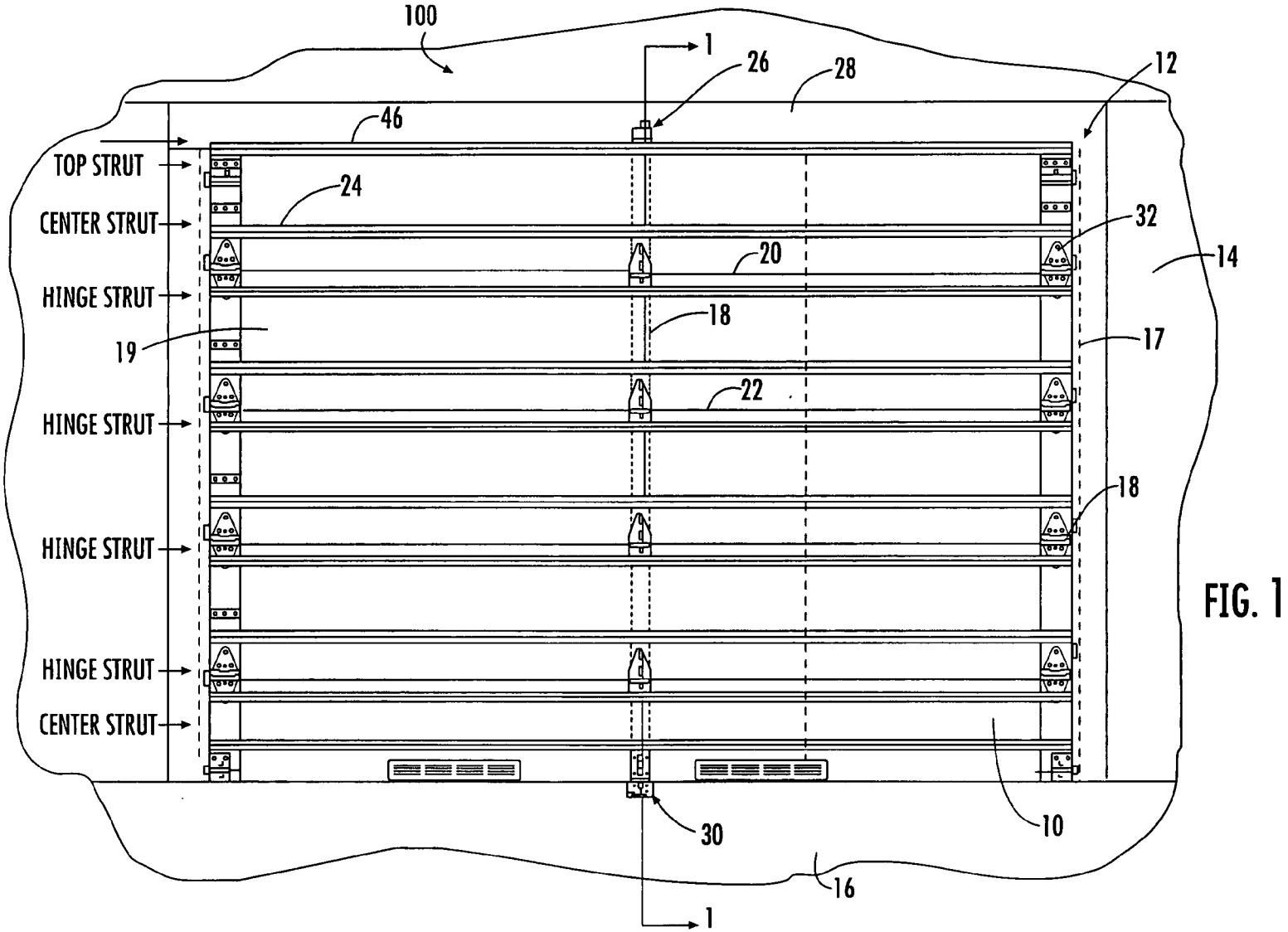
FIG. 1 is a pictorial view showing the inside of a garage door in a secured orientation with the reinforcement device of the present invention in place.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

With reference to FIG. 1, the automatically engaging reinforcement assembly 100 of the present invention is shown in use providing additional support to a building aperture cover, such as a garage door 10. The garage door 10 is illustrated as a generally rectangular, sectional, vertical opening type garage door. The garage door 10 is adapted to form a closure for a generally rectangular opening 12, defined by a vertical wall 14 and horizontal floor 16 of a building, such as a residential garage, for example. The garage door 10 is of substantially conventional construction, except as modified by the present invention, and is typical of vertical opening garage doors. However, the garage door of the present invention may also be utilized in other applications and may have specific design features different from some of the detail features of the door described herein.

The door 10 is made up of a plurality of hinged sections or panels. The sections are secured together by spaced apart hinges 32. The hinges 32 are connected to each of the sections adjacent respective lower and upper generally horizontal edges in a conventional manner. Each garage door section has elongated, generally horizontal extending upper edges 20 and lower edges 22, which are formed by folding the upper and lower panel edges and ends to form a somewhat tubular box beam-shaped configuration.

The garage door 10 is adapted to be moved from a closed position covering the opening 12 to a substantially open position along opposed guide-tracks 17 (FIG. 8, only one side shown), supported on wall 14 adjacent the opening 12. Spaced apart guide rollers 18 are supported on the respective sections and operable to ride in the guide tracks 17 in a conventional manner. The door 10 may be moved between open and closed positions by conventional mechanisms, including counterbalances, springs, and power operated openers (not shown).

Each of the garage door sections is provided with a plurality of spaced apart strengthening members or stiles 18 which extend between the upper edges 20 and lower edges 22 of each panel or section 19. The stiles 18 may comprise generally tubular, channel, or flat cross section members which are attached to the door sections faces between embossed sections or alternatively are attached to the horizontal extending upper edges 20 and lower edges 22 of the door sections 19.

The garage door 10 is preferably also provided with strengthening members comprising elongated struts or rails 24 extending across and suitably secured to the door sections.

Figure 8:
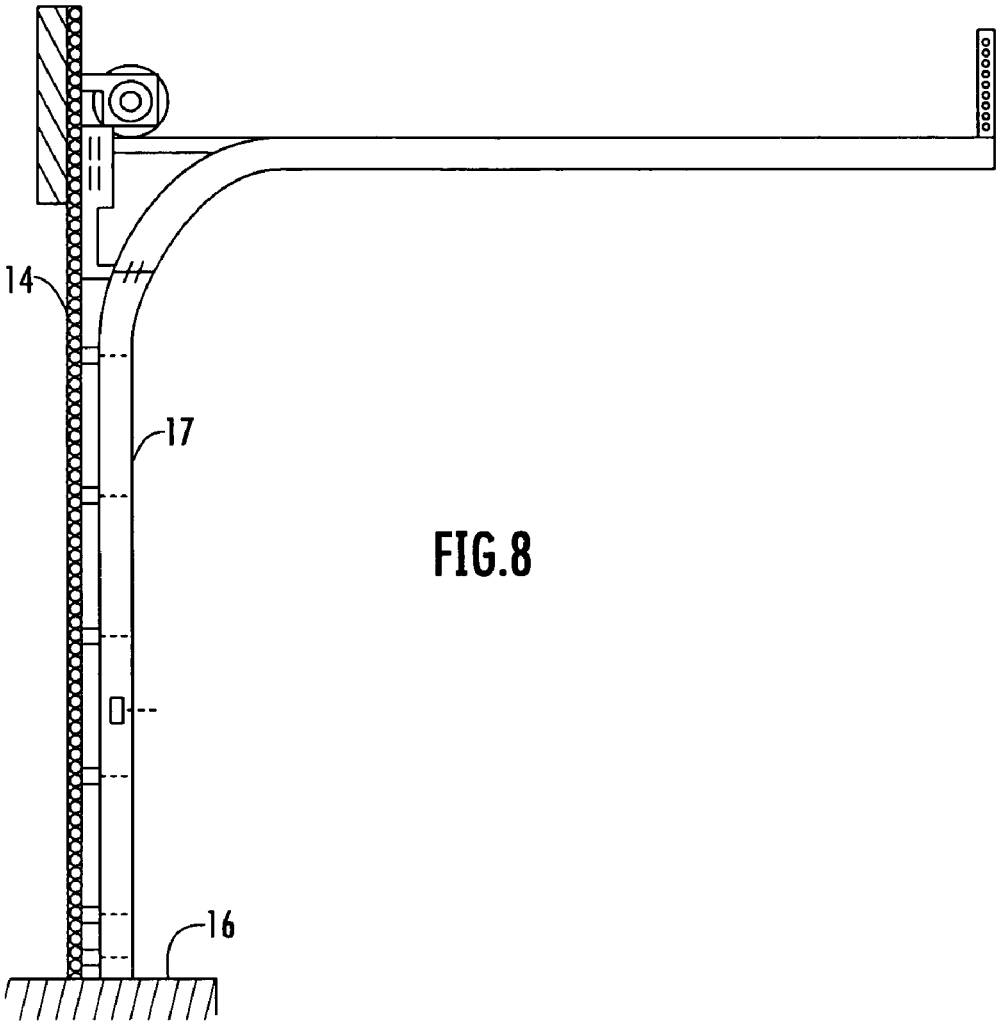
FIG. 8 is a side view of one guide track, illustrating the angular relationship between the guide track and the vertical wall containing the aperture.

The guide-tracks 17 may extend at a slight angle from the vertical in order to provide for movement of the garage door 10 away from the wall surface 14 when the door is being moved into an open position (FIG. 8). As a result of straight line winds, this slight inclination of the guide-tracks 17 and the outer surface of the garage door 10 will tend to produce a force component on the door, which may tend to "lift" the garage door 10 into an open position.

Figure 2:
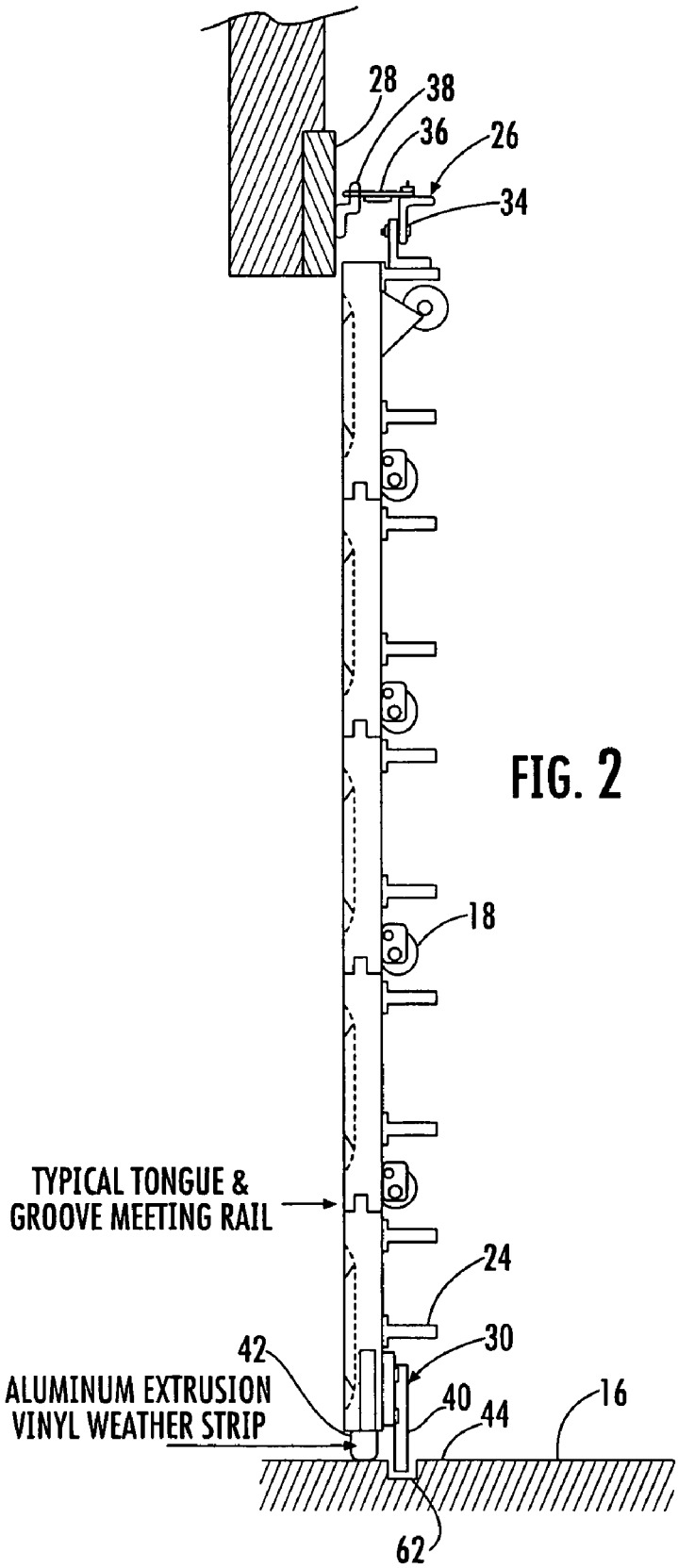
FIG. 2 is a section view of the garage door in FIG. 1 along lines 1—1, illustrating the cooperative engagement between the present invention and the building structure.

By way of overview, and with additional reference to FIG. 2, the reinforcement assembly includes at least one upper anchoring element 26, cooperating with the door header 28, and one lower anchoring element 30, cooperating with the floor structure 16. The upper anchoring element 26 utilizes a metal hook and wire rope loop arrangement which includes an adjustable bracket assembly 34, a flexible wire rope loop 36, and a metal hook member 38. The lower anchoring element 30 utilizes an engagement pin 40 that extends below the seal 42 of the bottom garage door section to cooperate with an anchor plate 44 securely fastened to the garage floor 16. When the garage door 10 is closed, the engagement pin 40 passively cooperates with a bottom anchor plate 44, and the wire rope loop 36 passively cooperates with the metal hook 38, as shown. With this arrangement, the upper and lower anchoring elements automatically maintain the garage door 10 in a secured orientation with respect to the building aperture 12.

Figure 3:
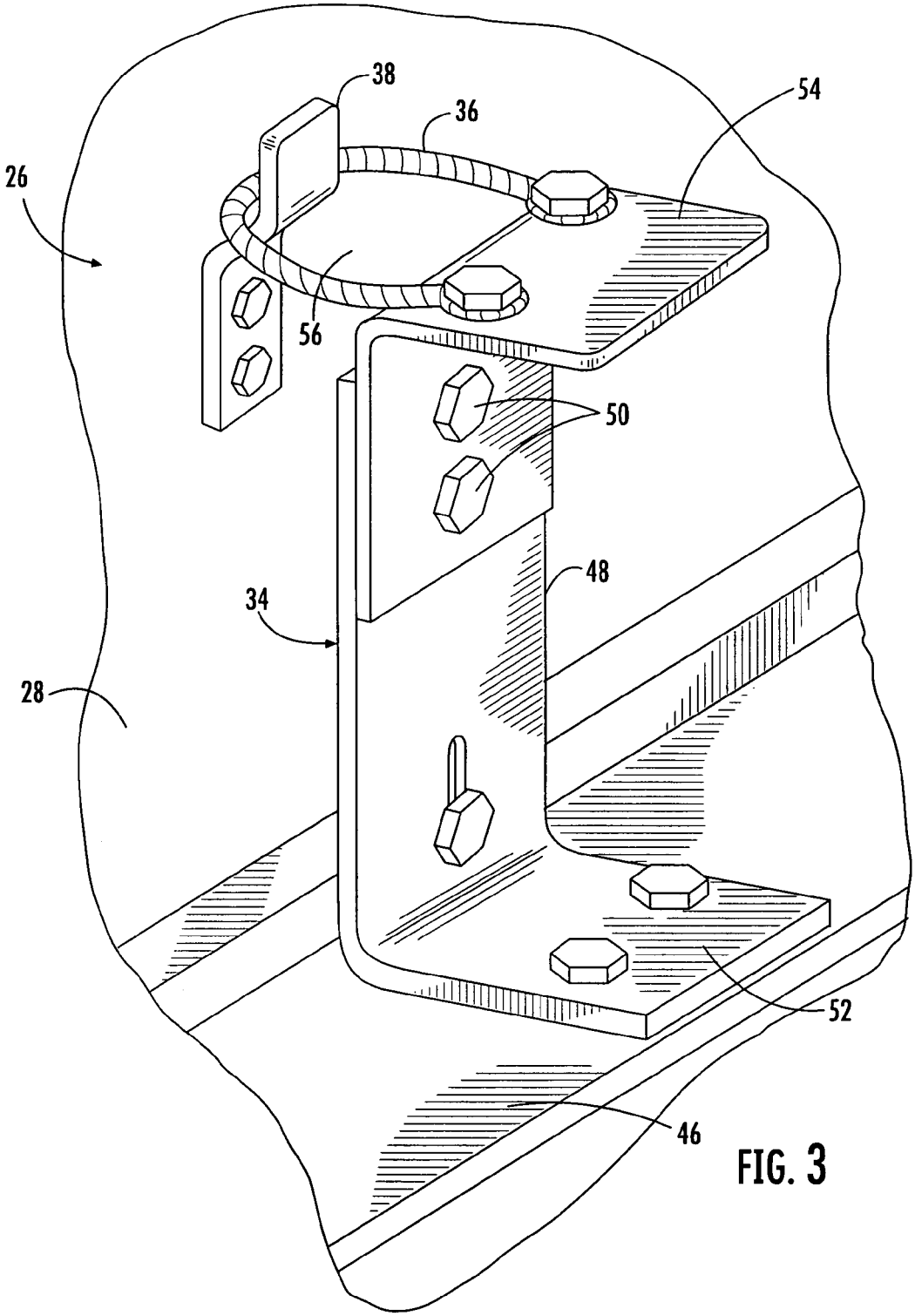
FIG. 3 is a close-up view of the upper anchoring element shown in FIG. 1.

Referring to FIG. 3, the upper anchoring element 26 is shown. The bracket assembly 34 extends vertically from the top strut 46 of the top door panel and includes two metal L-shaped elements 48 and 50, each having one leg adjustably attached to the other via bolts, screws or other suitable fastener well known in the art that would allow vertical adjustment of the bracket assembly 34 with respect to the substantially parallel first 52 and second ends 54. It is noted that the vertical adjustment may be permanently fixed, if desired. The first end 52 of the bracket assembly 34 is suitably attached to the top strut 46 of the garage door 10 via bolts, screws, or similar fastener. The wire rope loop 36 is preferably constructed from a length of flexible metal strands laid helically about a metallic or non-metallic core having each end attached to the second end 54 of the bracket assembly 34 forming an aperture 56 that aligns vertically with metal hook member 38 securely fastened to the header 28 of aperture 12. Alternatively, the wire rope loop may be constructed of other suitable materials well known in the art capable of withstanding the adequate tensile forces. The metal hook member 38 is generally S-shaped and constructed of a suitable metal to withstand the expected forces from the wind-loads. The metal hook member 38 should be suitably attached to the aperture header 28 and positioned so that it substantially aligns and cooperates with the wire rope loop when the garage door 10 is in the closed position and positioned sufficiently from the upper edge of the door section so as to allow clearance for the door 10 when it moves along the guide tracks 16 from a closed position to an open position. In this manner, the metal hook 38 and wire rope loop 36 arrangement reduce door flex and transfer a portion of the load to the structure, thereby reducing the loads placed on existing door-mounting hardware by high wind loads.

Figure 4:
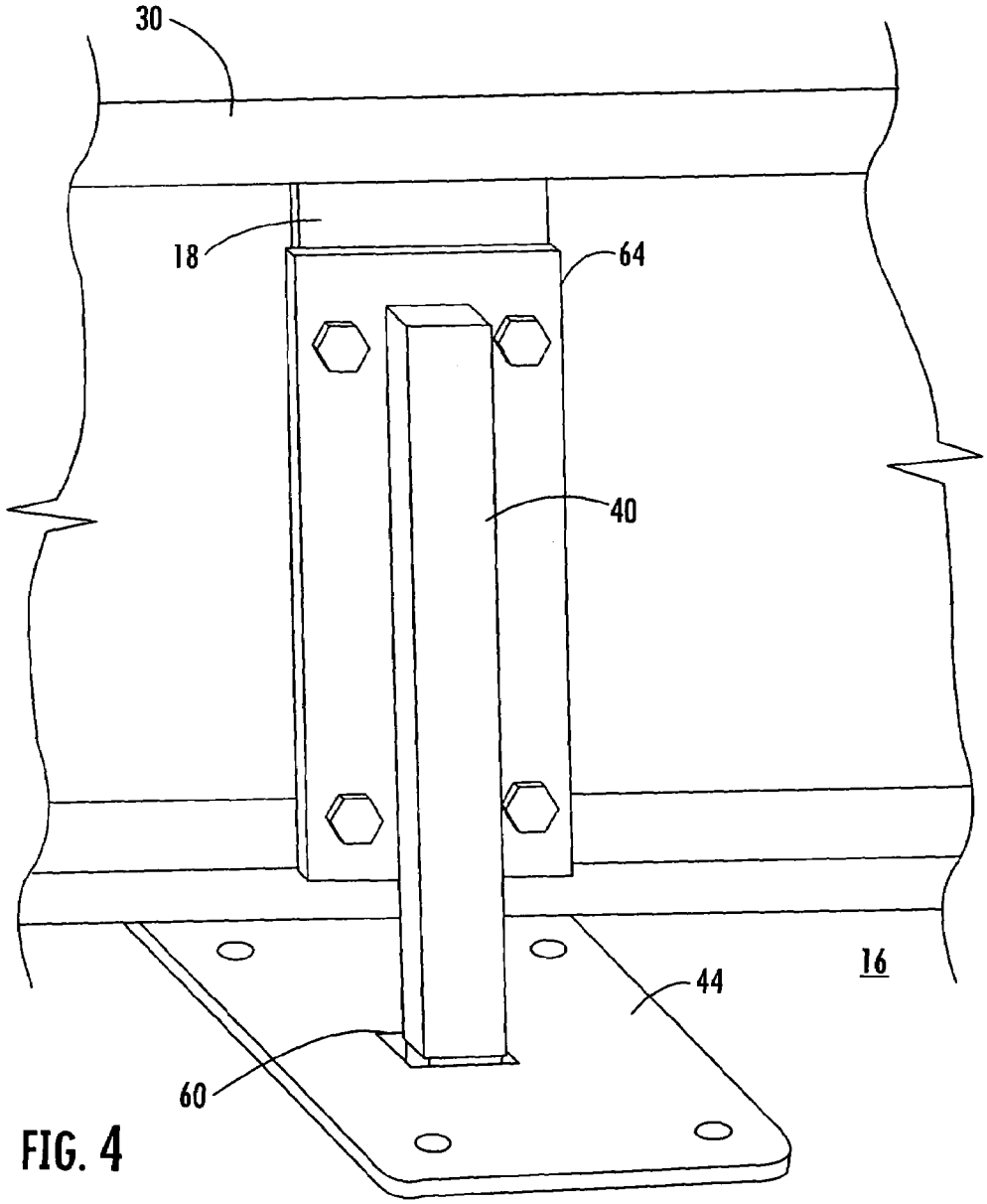
FIG. 4 is a close-up view of the lower anchoring element shown in FIG. 1.

Referring to FIG. 4, the lower anchoring element 30 is shown. The lower anchoring element 30 includes an engagement pin 40 and an anchor plate 44. The engagement pin 40 is suitably attached to a mounting plate 64, such as by weldment, and attached to a vertical intermediate stile 18 of the garage door 10 via bolts, screws, or a similar fastener. Bracing grooves 56 are disposed around the circumference of the first end of the engagement pin 40. The bracing grooves 56 engage corresponding aperture edges 58 in the anchor plate 44, as a tongue and groove arrangement, when the pin 40 shifts laterally during wind loads. The floor mounted anchor plate 44 includes a pin insertion aperture 60 that is sized to accommodate the engagement pin 40. Below the pin insertion aperture 60 and covered by the anchor plate 44 is a relief pocket 62 to allow insertion and proper operation of the engagement pin 40. The engagement pin 40 and mounting plate 44 are preferably constructed from cold rolled steel but may be constructed of other suitable materials well known in the art.

Figure 5:
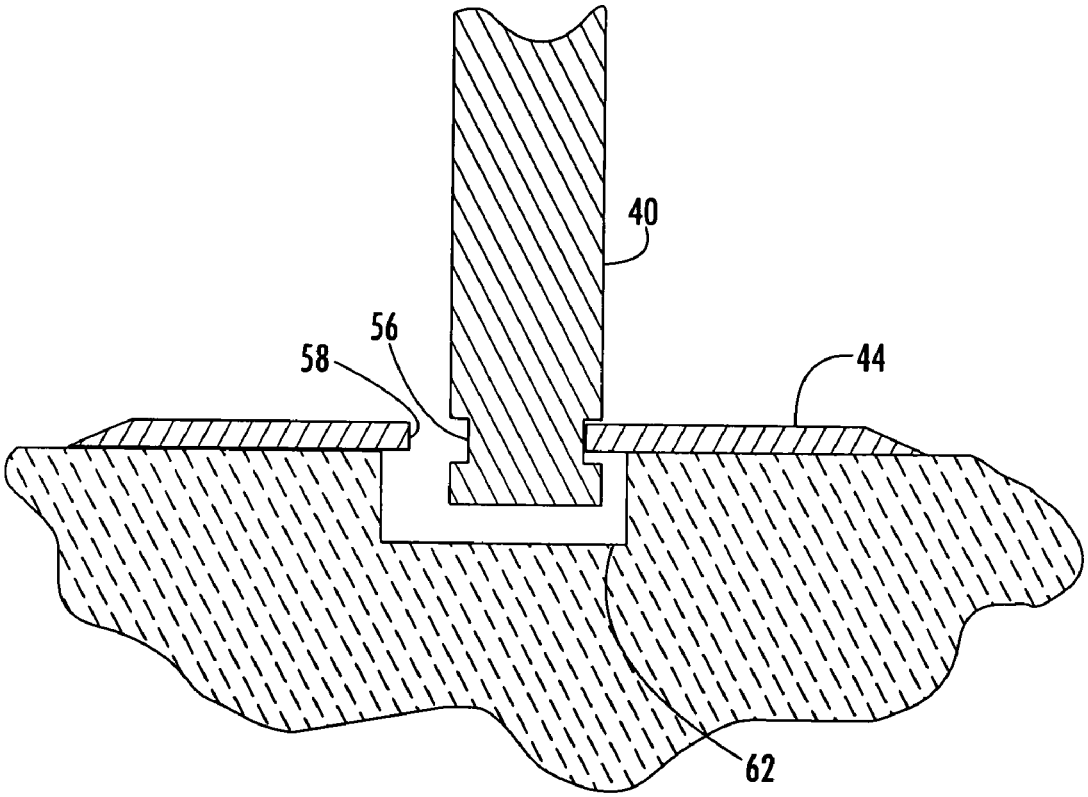
FIG. 5 is a partial section view of the lower anchoring element of FIG. 4, showing the tongue and groove arrangement in an engaged orientation.

Referring to FIG. 5, the cooperating tongue and groove arrangement of the engagement pin 40 and the anchor plate 44 is shown. As the garage door 10 is subjected to wind-loads, the door may shift forward or backward with respect to the building aperture 12. Positive-pressure wind-loads will tend to force the garage door 10 inward, while negative-pressure wind-loads will tend to pull the door outward. In each case, the engagement pin 40 will be forced against corresponding front or rear edges 58 within the associated anchor plate aperture 60. With this arrangement, the engagement pin groove 56 will engage the corresponding pin aperture edge 58, as a tongue and groove, preventing vertical motion of the door 10 during both positive and negative wind loads.

Figure 6:
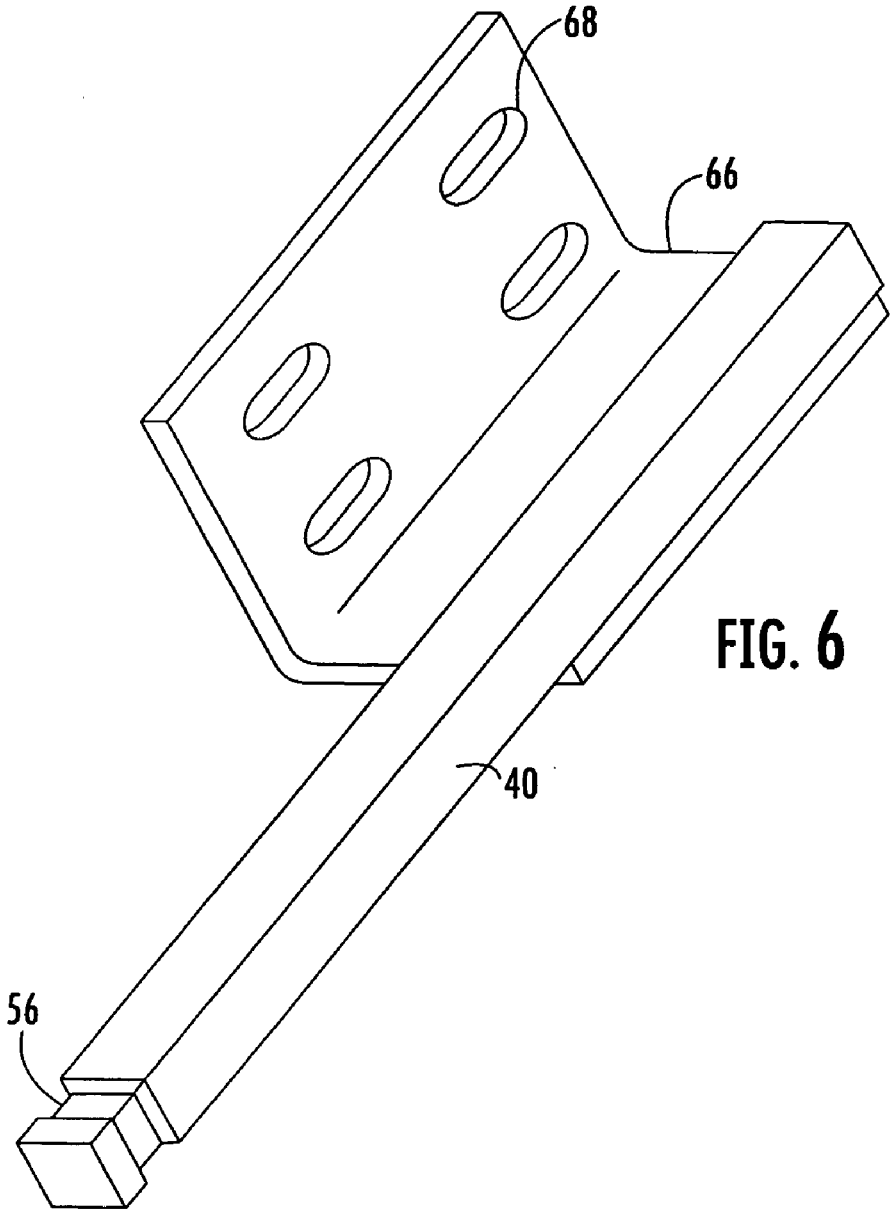
FIG. 6 is an alternative embodiment of the lower anchoring element allowing for the cooperative engagement point between the engagement pin and the floor to be spaced inwardly from the back side of the aperture cover.

Referring to FIG. 6, an alternative embodiment of the engagement pin assembly is shown wherein the mounting plate 66 is constructed in the form of an L. The first leg of the mounting plate is provided with fastener slots 68 for attachment and vertical alignment of the engagement pin 40. The engagement pin 40 is preferably attached to the mounting plate 66 by weldment or other suitable fastening means well known in the art.

Figure 7:
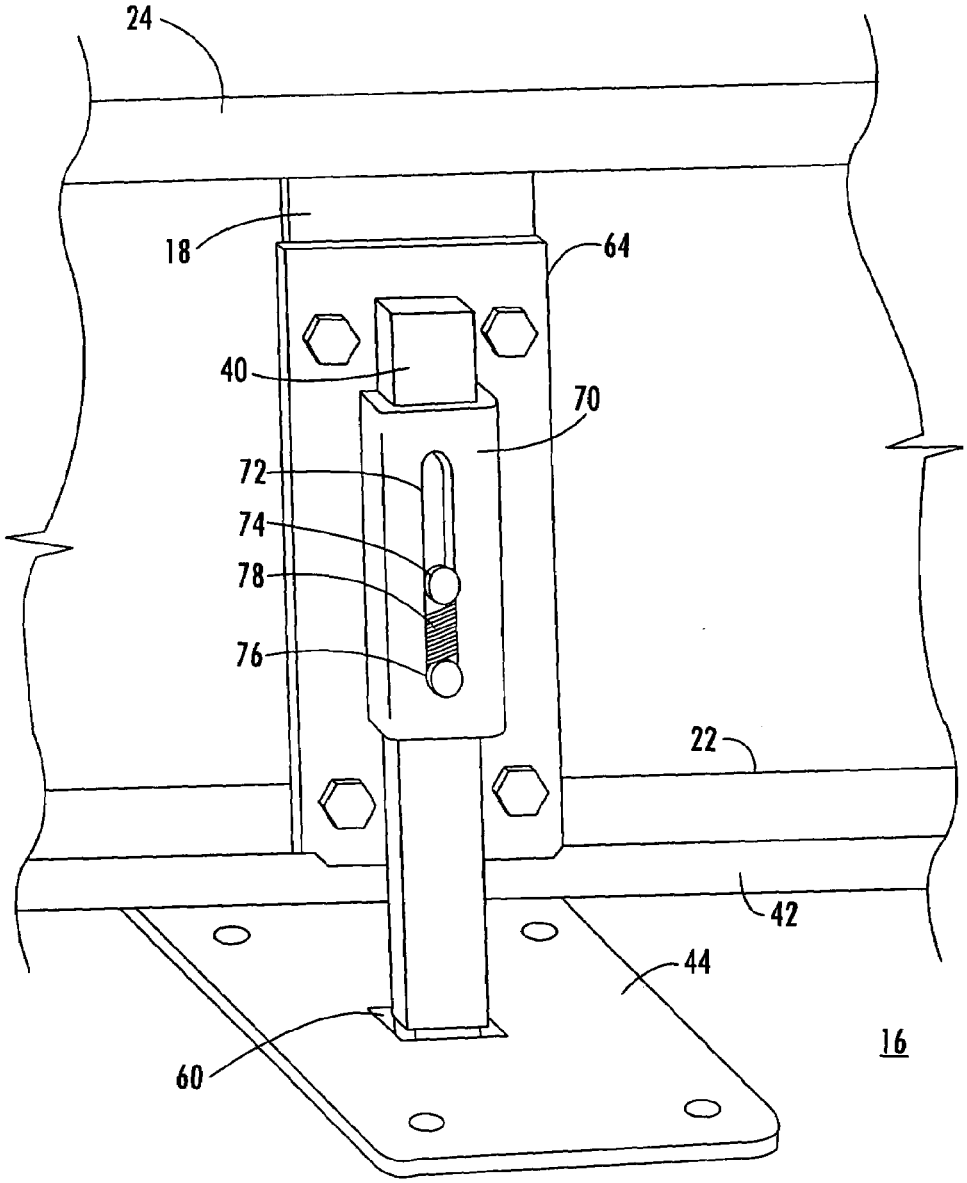
FIG. 7 is an alternative embodiment of the lower anchoring element wherein the engagement pin is spring loaded in an extended position to prevent damage to a vehicle in the event the aperture cover is inadvertently closed before the vehicle has completely entered or exited the building.

Referring to FIG. 7, an alternative embodiment of the engagement pin assembly is shown wherein the engagement pin 40 is slidably mounted on the mounting plate. The assembly includes a mounting plate 64 having a guide 70 suitably attached. A stop pin 74 is removably attached to the engagement pin 40 for cooperating with the elongated guide aperture 72. The guide aperture 72 and stop pin 74 limit the travel of the engagement pin 40. A resilient member 78 is attached between the stop pin 74 and a rigidly attached spring pin 76 to resiliently extend the engagement pin 40. In this manner the engagement pin 40 is able to retract in the event that the garage door 10 is inadvertently closed on a vehicle or person.

Referring to FIG. 8, a side view of the guide tracks 17 is shown, illustrating the angular relationship of the guide track 17 to the surface of the vertical wall 14 as described above.

In operation, the reinforcement device of the present invention is passively engaged by lowering the garage door 10. As the door 10 is lowered into a secured orientation the engagement pin 40 is inserted through the pin insertion aperture 60 located in the floor-mounted anchor plate 44, as the wire rope loop 36 of the upper anchoring element 26 is lowered over the metal hook member 38. As seen with particular reference to FIG. 1, the bottom anchoring plate 44 is secured to the garage floor 16, and the metal hook member 38 is attached to the door header 28. The device is passively disengaged by raising the garage door 10, thereby reversing the above described actions.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A reinforcement device for anchoring and securing a sectional aperture cover capable of being raised and lowered vertically in a building aperture, said aperture cover having a lower section and an upper section, said device comprising a hook adapted to be connected to said building immediately above said aperture, a bracket adapted to be connected in a stationary position to said upper section, a wire loop extending from said bracket adapted to engage said hook when said cover is lowered and disengage said hook when said cover is raised, a mounting plate adapted to be connected to said lower section, an engagement pin connected to said mounting plate and adapted to extend below said lower section, said engagement pin having a circumferential groove, an anchor plate adapted to be connected to the floor of said building below said aperture, said anchor plate including a pin aperture, said pin aperture having an edge, said engagement pin adapted to pass through said pin aperture when said aperture cover is lowered, said edge adapted to engage said groove when said cover moves laterally, said wire rope loop assembly includes a bracket assembly having a first end and a second end, said first end adapted for attachment to said upper section of said aperture cover and second end attached to said wire loop member, said bracket assembly includes two L-shaped elements, said L-shaped elements each having one leg adjustably attached to the other to allow vertical adjustment of said bracket assembly with respect to the substantially parallel first and second ends, said first end adapted for fixed attachment to said upper section of said aperture cover and said second end attached to said wire loop member.

2. The reinforcement device according to claim 1, wherein:

said engagement pin is movably attached to said plate and said engagement pin is spring biased in an extended position.

3. The combination of a reinforcement device and a sectional upward opening aperture cover to a building comprising:

said cover having an upper section and a lower section, said cover including a means for raising and lowering said cover, said means permitting lateral movement of said cover;

an upper securing means, said upper securing means including; at least one upper anchoring assembly, said upper anchoring assembly including;

(i.) a wire loop assembly; said wire loop assembly including;

(a.) a stationary bracket assembly, said bracket assembly including two L-shaped elements, said L-shaped elements each having one leg adjustably attached to the other to allow vertical adjustment of said bracket assembly and each having another leg perpendicular to said one leg and substantially parallel with respect to the other, said bracket assembly having first and second ends, said first end attached to said upper section of said aperture cover and said second end attached to a wire loop member;

(b.) a wire loop member, said wire loop member constructed from the length of wire rope having a first end and a second end, said first and second ends attached to said second end of said bracket assembly at spaced apart points, respectively, so that said wire rope forms said wire rope loop, said wire rope loop defining an aperture for receiving a metal hook;

(ii.) said metal hook being constructed and arranged to automatically receive said wire rope loop when said cover is lowered, said metal hook being adapted to be securely attached to the building;

a lower securing means, said lower securing means including; at least one lower anchoring assembly, said lower anchoring assembly including;

(i.) an anchor plate, said anchor plate adapted to be attached to said floor of said building, sand anchor plate having a pin aperture for receiving an engagement pin when said cover is lowered;

(ii.) said engagement pin attached to and extending from said lower section of said aperture cover, said engagement pin having at least one bracing groove disposed therein, said at least one bracing groove being adapted to engage an edge of said pin aperture disposed within said anchor plate when said engagement pin moves laterally;

whereby said upper securing means and said lower securing means are adapted to passively maintain said aperture cover in a secured orientation with respect to said building.

4. The reinforcement device according to claim 3, wherein:

a mounting plate connected to said lower section, said engagement pin is movably attached to said plate and a spring attached at one end to said plate and at attached at the other end to said pin whereby said engagement pin is spring biased in an extended position.

* * * * *